United States Patent [19]

Lampman

[11] 4,449,765

[45] May 22, 1984

[54] DISHRACK WHEEL ASSEMBLY FOR A DISHWASHER

[75] Inventor: William T. Lampman, St. Joseph Township, Berrien County, Mich.

[73] Assignee: Whirlpool Corporation, Benton Harbor, Mich.

[21] Appl. No.: 385,855

[22] Filed: Jun. 7, 1982

[51] Int. Cl.[3] ..... A47B 88/04

[52] U.S. Cl. ..... 312/311; 16/267; 312/301; 312/341 R

[58] Field of Search ..... 256/48, 50; 403/391, 403/397; 16/30, 267; 248/221.3, 221.4, 222.2, 222.3, 430; 312/311, 341, 301

[56] References Cited

U.S. PATENT DOCUMENTS

| | | | |
|---|---|---|---|
| 1,149,541 | 8/1915 | Rees | 248/222.2 X |
| 3,194,610 | 7/1965 | Stewart | 312/341 R |
| 3,269,548 | 8/1966 | Geiger et al. | 312/341 R |
| 3,672,743 | 6/1972 | Pompey | 312/311 |
| 3,789,800 | 2/1974 | Steudler, jr. | 248/221.4 X |
| 3,799,640 | 3/1974 | Jacobs | 312/311 |
| 4,019,794 | 4/1977 | Rowe | 312/311 |
| 4,057,872 | 11/1977 | Schmidt | 312/311 |
| 4,097,099 | 6/1978 | Spiegel | 312/311 |
| 4,340,144 | 7/1982 | Cousins | 248/222.2 X |
| 4,362,346 | 12/1982 | Emmert | 312/311 |

*Primary Examiner*—William E. Lyddane
*Assistant Examiner*—Joseph Falk
*Attorney, Agent, or Firm*—Wood, Dalton, Phillips, Mason & Rowe

[57] ABSTRACT

A dishwasher structure having improved wheel assemblies for providing rolling mounting of a dishrack on tracks provided on the sidewalls of the dishwasher cabinet. The wheel mounts are arranged to be mounted to portions of the dishrack and in the two illustrated embodiments, include hooks for facilitated installation on wire portions of the dishrack. In one embodiment, the wheel mount includes a shroud which extends above and inwardly of the wheel while permitting the wheel to be located closely adjacent the sidewall of the cabinet, permitting effectively maximizing of the width of the dishrack.

8 Claims, 8 Drawing Figures

FIG. 1
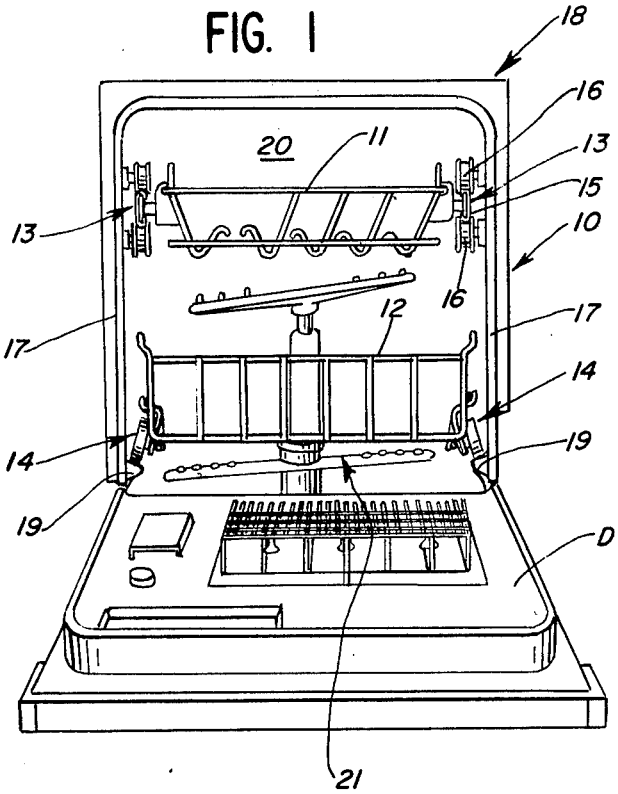
FIG. 2
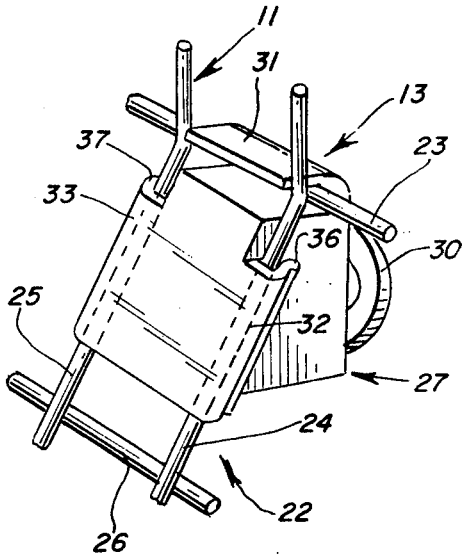
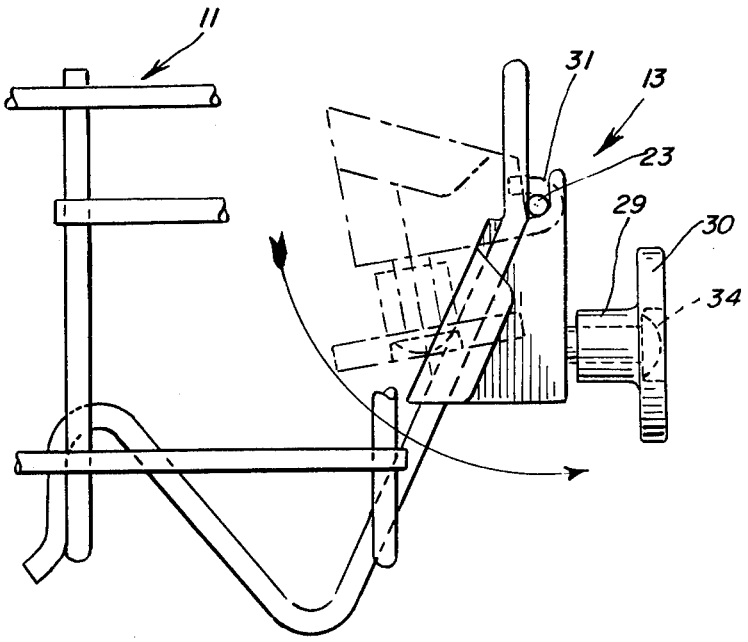
FIG. 3
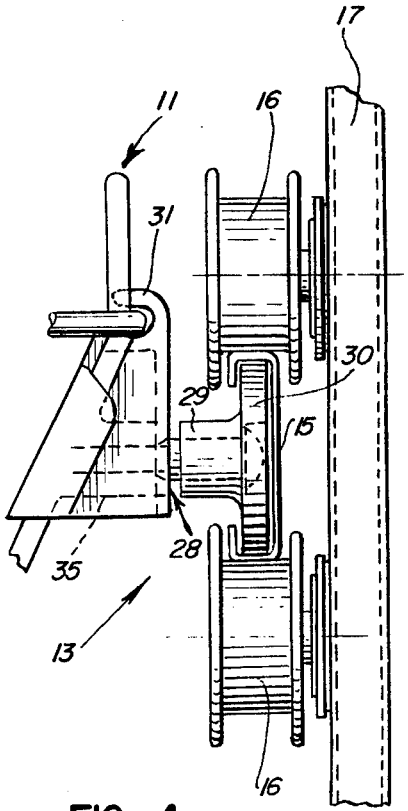
FIG. 4

FIG. 5
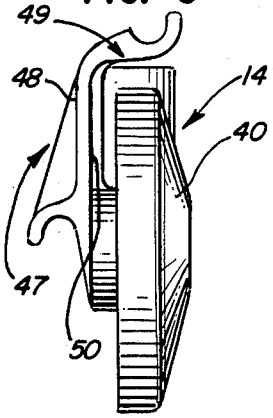
FIG. 6
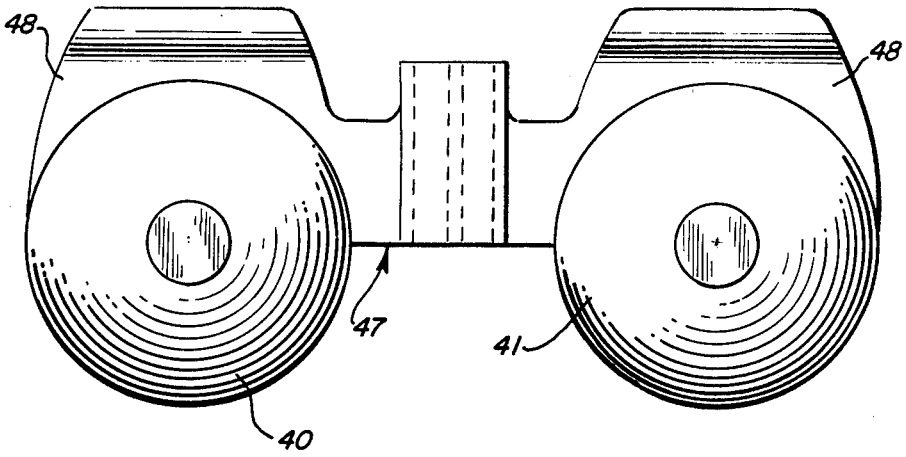
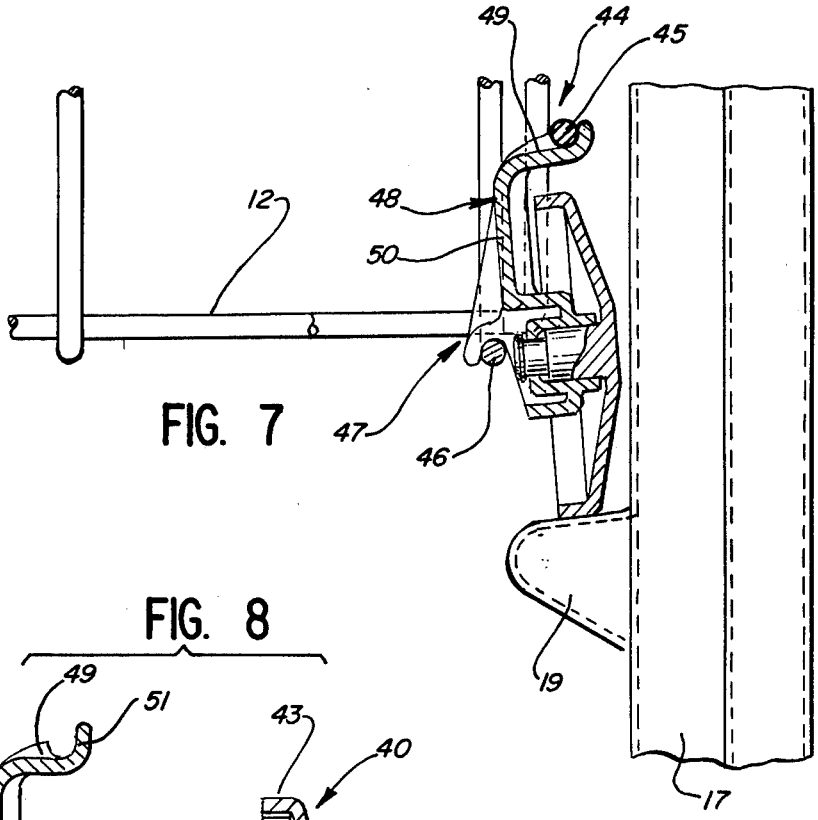
FIG. 7
FIG. 8
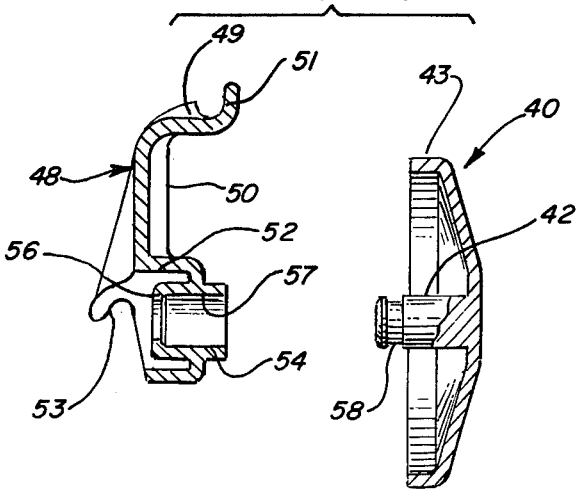

DISHRACK WHEEL ASSEMBLY FOR A DISHWASHER

BACKGROUND OF THE INVENTION

1. Field of the Invention

This invention relates to dishwashers and in particular to means for mounting wheels to a dishrack.

2. Description of the Prior Art

In one conventional form of dishwasher, a dishrack is provided with wheels at the opposite sides thereof for rolling on a track provided in the sidewall of the dishwasher cabinet, and more specifically, in the sidewall of the dishwasher tub.

It has been found that food soil tends to collect on the wheel assemblies in the use of the dishwasher. It is desirable to provide means for permitting self-cleaning of the wheel assemblies.

It is further desirable in the provision of such wheel assemblies to effectively minimize the cost and provide facilitated assembly thereof in the dishrack structure.

One excellent example of a wheel assembly for use in dishracks and the like is illustrated in U.S. Pat. No. 3,194,610 of Bruce E. Stewart, which patent is owned by the assignee hereof. As shown therein, each of the wheels is mounted in a shroud having opposite axle mounting openings and effectively covering the top portion of the wheel. The shroud includes means defining an upwardly opening hook for engaging one of the dishrack wires, and a downwardly opening hook for engaging another of the dishrack wires.

In U.S. Pat. No. 3,269,548, Russell C. Geiger et al disclose a dishwashing rack wheel assembly having different shroud and mounting structures.

In U.S. Pat. No. 3,672,743, Walter Pompey discloses a roller and retainer for a wire basket such as for use in a dishwasher.

James W. Jacobs discloses, in U.S. Pat. No. 3,799,640, another form of dishrack wheel assembly.

In U.S. Pat. No. 4,057,872, Bradley J. Schmidt discloses a support mount for mounting a wheel to a wire basket or the like. The basket wire defines a bi-legged eyelet to which the mount is secured. The wheel mount itself includes an axle for rotatably carrying the wheel and an axle extension. A backing plate is formed at an end of the axle extension and supports a plurality of arms embracibly engaging the wire basket eyelet. A backup skirt is provided for inhibiting tipping of the mount.

In U.S. Pat. No. 4,019,794, Richard A. Rowe discloses a wheel for use in a dishwasher rack which includes a flexible peripheral flange for preventing the wheel from cutting the tub and door lining material. The wheel also includes a radiused portion adjacent the tub wall for preventing the wheel from scoring the tub wall and serving to keep the rack in alignment by abutment thereof with the tub sidewall.

In U.S. Pat. No. 4,097,099 of Raymond William Spiegel, which patent is owned by the assignee hereof, another form of dishrack wheel assembly is disclosed having two pairs of spaced wheels on the cabinet sidewall, with a track member longitudinally movable therebetween.

SUMMARY OF THE INVENTION

The present invention comprehends improved wheel mounting means for use in a dishwasher or the like. The invention comprehends, in one embodiment, an improved wheel assembly including a wheel having a hub, and a track-engaging peripheral portion, support means on the dishrack including a horizontal top element extending longitudinally parallel to the track, a pair of downwardly and inwardly inclined spaced side elements and a carrier having means for journaling the hub of the wheel for rolling on the track, a top hook hooked onto the top element for retaining the carrier against downward displacement, and opposed side hooks embracing the side elements for retaining the carrier in a preselected position against outward swinging movement about the top element.

In another embodiment, the invention comprehends the provision of an improved wheel assembly including a wheel having a hub, and a track-engaging peripheral portion, support means on the dishrack including a horizontal upper element extending longitudinally parallel to the track, a horizontal lower element extending horizontally parallel to the track, a one-piece wheel mount defining a shroud including a top wall portion and an inner upright wall portion, a top hook engaging the top element for retaining the carrier against upward displacement, and a bottom hook engaging the bottom element for retaining the carrier against swinging movement about the top element, and means for rotatively mounting the wheel on the wheel mount outwardly of the shroud upright portion and under the top wall portion, the top wall portion extending outwardly substantially only to cover the outermost portion of the wheel for permitting the wheel to be closely juxtaposed to the dishwasher cabinet sidewall and thereby permit the dishrack to have effectively maximum width between the sidewalls.

The invention permits an increase in the width of the dishwasher dishrack so as to provide more usable rack space within the outer dishwasher cabinet. The invention comprehends providing novel arrangements of the wheel assemblies permitting the wheels to be disposed closely adjacent the sidewalls of the dishwasher cabinet or tub while concurrently permitting the sidewalls of the dishwasher rack to be spaced closely adjacent the same.

The wheel assemblies of the present invention are extremely simple and economical of construction while yet providing the highly improved optimization of the use of the dishwashing space provided in the dishwasher cabinet by permitting the dishracks to have maximum width while yet assuring positive troublefree rolling movement of the racks on the cabinet tracks.

BRIEF DESCRIPTION OF THE DRAWING

Other features and advantages of the invention will be apparent from the following description taken in connection with the accompanying drawing wherein:

FIG. 1 is a front perspective view of a dishwasher having improved wheel mounting means embodying the invention;

FIG. 2 is a fragmentary perspective view of a wheel mounting means embodying the invention;

FIG. 3 is a fragmentary vertical section illustrating the mounting of the wheel mounting means of FIG. 2 to the dishrack;

FIG. 4 is a fragmentary vertical section illustrating the association of the wheel means of FIG. 2 mounted on the dishrack for rolling engagement with the track carried by the dishwasher sidewall;

FIG. 5 is an end elevation of another wheel mounting means embodying the invention;

FIG. 6 is a side elevation thereof;

FIG. 7 is a fragmentary vertical section illustrating the mounting of the wheel mounting means of FIG. 5 to the dishrack, with the wheels thereof engaging a track carried on the sidewall of the diswasher cabinet; and FIG. 8 is a fragmentary exploded diametric section of the wheel mounting means of FIG. 5.

DESCRIPTION OF THE PREFERRED EMBODIMENTS

In the illustrative embodiments of the invention as disclosed in the drawing, a dishwasher generally designated 10 is provided with an upper dishrack 11 and a lower dishrack 12. The upper dishrack is provided at opposite sides with at least two wheel assemblies per side generally designated 13 and the lower rack is provided at its opposite sides with at least two wheel assemblies per side generally designated 14.

Wheel assemblies 13 are received in tracks 15 longitudinally movable between pairs of rollers 16 carried by the sidewall 17 of the dishwasher cabinet 18.

The lower wheel assemblies 14 roll on suitable tracks 19 provided on the sidewalls 17 of the cabinet.

As seen in FIG. 1, cabinet 18 defines a dishwashing space 20, in which the racks 11 and 12 are movably mounted, with spray means 21 provided for spraying dishwashing liquid upwardly against dishes and the like placed in the racks 11 and 12, respectively. Access to dishwashing space 20 is controlled by a closure door D hingedly mounted to the cabinet to swing downwardly to an open position, as seen in FIG. 1, wherein the dishracks may be rolled outwardly as for loading and the like.

Each of the upper wheel assemblies 13 is similar and is disclosed in greater details in FIGS. 2–4. As seen in FIG. 2, the dishrack 11 includes support means generally designated 22 including a top, horizontally elongated element 23 which extends generally parallel to track 15. Support 22 further includes a pair of downwardly and outwardly inclined spaced side elements 24 and 25, and a bottom element 26 extending parallel to top element 23.

The upper wheel assembly 13, as shown in FIG. 4, includes a carrier generally designated 27 having means generally designated 28 for journaling the hub 29 of a wheel 30 for rotatively mounting the wheel to the carrier.

As shown in FIGS. 2–4, the carrier includes a top hook 31 hooked onto the top element 23 for retaining the carrier against downward displacement, and opposed side hooks 32 and 33 embracing the side elements 24 and 25, respectively, for retaining the carrier in a preselected position against outward swinging movement about the top element 23.

Wheel 30 is rotatably mounted to the carrier by an axle element 34 extending through the hub 29 of the wheel and received in a mounting portion 35 of the carrier.

As best seen in FIG. 2, the width of the carrier mounting portion and the diameter of wheel 30 are less than the spacing between the side elements 24 and 25. In the illustrated embodiment, mounting portion 35 comprises a solid axle mounting portion. The carrier, including the hooks 31, 32 and 33, comprises a one-piece element which illustratively may be formed of molded synthetic resin.

As best seen in FIG. 2, the side hooks 32 and 33 define inturned distal end portions 36 and 37, respectively, for releasably locking the side hooks to the side elements 24 and 25.

As seen in FIG. 3, the top hook 31 is defined by a U-shaped cross section.

As further illustrated in FIG. 3, the wheel assembly is readily installed on the dishrack support portion 22 by moving the assembly downwardly between the side elements 24 and 25 from a raised disposition, shown in broken lines in FIG. 3, wherein the hook 31 is hooked about the top support element 23. As the wheel diameter is smaller than the spacing between the side elements 24 and 25 and the width of the carrier wheel mounting portion is less than the spacing therebetween, the wheel assembly may be readily swung from the broken line position downwardly between the rack support elements 24 and 25 to bring the side hooks 32 and 33 into embracing relationship with the side elements 24 and 25 of the dishrack support means. The inturned hook portions 36 and 37 releasably retain the wheel assembly in the installed disposition of FIG. 2, with the wheel 30 disposed for reception in the track 15, as illustrated in FIG. 4.

The improved wheel assemblies 13 permit the widening of the dishrack so as to provide more usable rack space within the dishwasher. When locked in place, the wheel assembly locates the wheel 30 closely adjacent the outward vertical plane of the dishrack while, at the same time, providing improved support for the drive screw axle 34.

Referring now to the embodiment of FIGS. 5–7, another form of improved wheel assembly generally designated 14 is shown to comprise a pair of wheels 40 and 41, each having a hub 42 and a track-engaging portion 43.

A support portion generally designated 44 on the dishrack 12 includes an upper horizontally extending wire element 45 and a lower horizontally extending wire element 46, each of which extends generally parallel to the track 19, as illustrated in FIG. 7.

The wheels are carried on a one-piece wheel mount generally designated 47 defining a shroud 48. The shroud includes a top wall portion 49 and an inner upright wall portion 50.

As seen in FIG. 8, the top wall portion defines an upwardly opening hook 51. The lower end 52 of the shroud defines a downwardly opening hook 53 extending inwardly from the upright shroud portion 48.

The lower end 52 of the shroud further defines an outwardly projecting axle mounting portion 54 in which the axle 42 of wheel 40 is rotatably journaled. The wheel is rotatively locked to the mounting portion 54 by a snap-on connector portion having a locking deformable rim 56 extending into the bore 57 of the hub mounting portion 54. Axle 42 includes a circumferential recess 58 such that when the axle 42 is inserted in bore 57, rim 56 snaps into recess 58 to rotatably lock the axle 42 and thus wheel 40 to the wheel mount 47.

As best seen in FIG. 7, top wall 49 extends outwardly substantially only to cover the outermost portion of the wheel for permitting the wheel to be closely juxtaposed to the dishwasher cabinet sidewall 17, thereby permitting the dishrack 12 to have effectively maximum width between the sidewalls of the cabinet.

As best seen in FIG. 6, the wheel mount 47 defines a pair of similar shrouds 48 for mounting one each the respective wheels 40 and 41, whereby each of the wheel mounts provides a pair of wheels rolling on the track 19 at opposite sides of the dishwasher space 20.

In the illustrated embodiment, each of the hooks is formed integrally with the shroud, with the bottom hook 53 and hub mounting portion 54 being formed integrally with the lower portion 52 of the shroud. The top wall 49 curves downwardly into the upright shroud wall portion 50 to shield the wheel from dishwashing liquid and soil particles moving downwardly onto the shroud. The wheels are maintained clean by the dishwashing liquid directed thereagainst by the spray arm means 21 as it rotates so as to dislodge any particles collecting on the inside of the shroud. As the shroud extends only partly over the top of the wheel, the dishrack width may be maximized without the shroud contacting the cabinet sidewalls.

Thus, each of the improved wheel mounting means provides for facilitated self-cleaning in the normal operation of the dishwasher while yet providing for improved maximizing of the width of the dishrack carried by the wheel mounting assemblies. Each of the wheel mounting assemblies is extremely simple and economical of construction and may be readily installed and removed as desired. Each of the assemblies includes a one-piece shroud and support mounting means permitting the element to be formed at low cost as by being formed of molded synthetic resin. In each of the embodiments, the wheel is readily exposed for facilitated cleaning to assure troublefree rolling movement thereof relative to the associated track means of the dishwasher unit.

The foregoing disclosure of specific embodiments is illustrative of the broad inventive concepts comprehended by the invention.

I claim:

1. In a dishwasher having a cabinet defining outer sidewalls at opposite sides of a dishwashing space within the cabinet, horizontal tracks on the sidewalls, and a dishrack, a pair of improved wheel assemblies for movably carrying the dishrack on the sidewall tracks for movement into and from the dishwashing space, each said wheel assembly comprising:

a wheel having a hub and a track-engaging peripheral portion;

support means on said dishrack including a horizontal top element extending longitudinally parallel to the track, and a pair of downwardly and inwardly inclined spaced side elements; and a carrier having means for journaling the hub of the wheel for rolling on the tracks, a top hook opening horizontally when hooked onto said top element for retaining the carrier against downward displacement, and opposed side hooks embracing said inclined side elements for retaining the carrier in a preselected position against outward swinging movement about said top element.

2. The dishwasher structure of claim 1 wherein said carrier outwardly of said side hooks has a width less than the spacing between said side elements permitting the carrier to be installed on said support by swinging the carrier outwardly between said side elements with the top hook swingably hooked about said top element to a position wherein the side hooks engage the side elements to effect retention of the carrier.

3. The dishwasher structure of claim 1 wherein each of the diameters of said wheel and the width of the carrier outwardly of said side hook is less than the spacing between said side elements permitting the carrier to be installed on said support by swinging the carrier outwardly between said side elements with the toop hook swingably hooked about said top element to a position wherein the side hooks engage the side elements to effect retention of the carrier.

4. The dishwasher structure of claim 1 wherein said carrier defines a solid axle support portion, and said wheel is mounted to said axle support portion by an axle extending through the wheel hub into said axle support portion.

5. The dishwasher structure of claim 1 wherein said carrier comprises a one-piece element.

6. The dishwasher structure of claim 1 wherein said carrier comprises a one-piece molded synthetic resin element.

7. The dishwasher structure of claim 1 wherein said side hooks define inturned distal end portions releasably locking the side hooks to said side elements of the support.

8. The dishwasher structure of claim 1 wherein said top hook is defined by a U-shaped cross section.

* * * * *